US006785944B1

(12) United States Patent
Herbkersman et al.

(10) Patent No.: US 6,785,944 B1
(45) Date of Patent: Sep. 7, 2004

(54) ENGINE INSTALLATION JIG

(75) Inventors: Bruce Herbkersman, Virginia Beach, VA (US); Bobby Heninger, Virginia Beach, VA (US); Casey Lynn, Eustis, FL (US); Rick Richert, Eustis, FL (US)

(73) Assignee: Volvo Penta of the Americas, Chesapeake, VA (US)

( * ) Notice: Subject to any disclaimer, the term of this patent is extended or adjusted under 35 U.S.C. 154(b) by 0 days.

(21) Appl. No.: 10/086,716

(22) Filed: Mar. 4, 2002

(51) Int. Cl.[7] ..... B25B 27/14

(52) U.S. Cl. ..... 29/281.1; 29/407.09; 29/407.1; 29/559; 269/152; 408/72 R

(58) Field of Search ..... 29/407.05, 407.09, 29/407.1, 559, 281.1, 281.4, 257; 269/87.3, 294, 152, 249; 408/241 G, 704, 708, 103, 108, 115 R, 72 R

(56) References Cited

U.S. PATENT DOCUMENTS 280,956 A * 7/1883 Rieppel ..... 408/103
3,001,244 A * 9/1961 Kronquist ..... 29/407.1
3,465,620 A * 9/1969 Hilburn ..... 408/115 R
3,807,889 A * 4/1974 Kiezel ..... 408/108
5,174,693 A * 12/1992 Lee et al. ..... 408/108
6,099,213 A * 8/2000 Kammeraad et al. ... 408/115 R
6,499,918 B1 * 12/2002 Murphy ..... 408/72 R

FOREIGN PATENT DOCUMENTS

GB 2281395 A * 3/1995

* cited by examiner

*Primary Examiner*—David P. Bryant
*Assistant Examiner*—Jermie E. Cozart
(74) *Attorney, Agent, or Firm*—Howrey Simon Arnold & White, LLP; Michael J. Bell

(57) ABSTRACT

An engine installation jig and method for installing an engine in a marine vessel according to predetermined engine installation criteria. The jig comprises a longitudinal member, two lateral crossbar members and a fixture head. The jig also includes leveling devices for manipulating the position of the jig relative to the marine vessel and at least one leveling sensor for providing a visual indication of the planar orientation of the jig within the marine vessel. The jig is coupled to the marine vessel via the leveling devices and the fixture head. Once the jig has been aligned and installed, engine mount holes are drilled in either the stringers or the stringer brackets of the marine vessel, the engine set into the marine vessel so that the engine mounts align with the drilled engine mount holes, and the engine installed.

11 Claims, 4 Drawing Sheets

ENGINE INSTALLATION JIG

BACKGROUND OF THE INVENTION

The invention relates to a device and method for aligning and installing inboard boat engines of varying sizes and configurations.

Inboard engines generally are large, powerful engines, used to drive larger marine vessels. Exclusively inboard engines are typically mounted inside the hull of the boat and mated to a propeller shaft passing through the bottom of the boat hull. Inboard engines can also be part of a marine stem drive. Marine stem drives include both an inboard engine and an outdrive. In a stem drive, the inboard engine is usually coupled to the outdrive, through the transom of the boat, via a drive shaft or the like.

Inboard engines may weigh thousands of pounds. Setting such a heavy engine within the engine bed of a boat commonly requires considerable manpower and the use of heavy machinery. Furthermore, the engine must be precisely vertically and horizontally aligned with both the hull and the propeller shaft of the boat. Since no boat is assuredly manufactured to exact specifications, precisely setting and aligning the engine in a boat is a time-consuming and cumbersome task.

Yet, the need for this precision cannot be ignored. An even slightly misaligned engine can significantly hinder the performance and comfort of a boat. A misaligned engine is often responsible for, among other things, excess vibration, reduced fuel economy and engine efficiency, undue wear on the engine and transmission components and increased strain on the engine mounts and propeller shaft.

An inboard boat engine is conventionally mounted directly upon a pair of longitudinal stringers, extending through the interior hull of the boat, or on stringer brackets coupled to the stringers. Moreover, an inboard engine is necessarily mated to the propeller shaft through the bottom of the boat hull. However, before the engine is secured to the boat and mated to the propeller shaft, it must be precisely aligned. Once the engine is aligned to both the boat hull and the propeller shaft, it is installed. Holes matching the holes on the engine mounts are drilled in either the stringers or the stringer brackets through which the engine and the boat are joined.

The mount holes are frequently drilled and the propeller shaft aligned while the engine is already set in place. This procedure is problematic. Once the engine has been lowered into place, there is often inadequate clearance within the engine bed to drill the engine mount holes or even align the engine with the boat hull and the propeller shaft.

As a solution to this problem, inboard engine installers began marking the mount holes for subsequent drilling. However, this process requires the engine be removed, the holes drilled and the engine again lowered into place and secured. As explained above, removing and then precisely realigning the bulky engine adds substantial hours of labor to the engine installation. As a result, the manufacturing costs of the boat increase.

Consequently, it is desirable to minimize the adjustments to the engine after the engine has been installed. Accordingly, it is advantageous to precisely locate and drill the engine mount holes prior to dropping the engine into place within the engine bed. It is also desirable that the engine mount holes are precisely located so that the propeller shaft and the propeller drive of the engine are precisely aligned.

In the past, engine alignment and installation tools have been proposed for vertically and horizontally locating engine mounts. U.S. Pat. No. 4,957,462, for example, discusses a tool and method for vertically and horizontally locating front engine mounts of a marine stern drive. However, the '462 patent does not address the need for locating the rear engine mounts of an inboard boat engine. In addition, the tool of the '462 patent is not adaptable for use with a broad range of inboard engine makes and models.

Other proposed designs of engine alignment and installation tools have attempted to expand the use of the tool to inboard engines of varying sizes and configurations. These designs may include interchangeable frame members and frame attachments. However, to date, the field of use of the existing engine alignment and installation tool designs is limited to those adapted for use with engines made by a single engine manufacturer.

There is therefore a need for an inboard engine installation jig and method that allows for simple and precise, three-dimensional engine mount and propeller shaft location and alignment, prior to the installation of the engine, and for a wide range of engine sizes and configurations, including engines of multiple manufacturers. There is also a need for an inboard engine installation jig that is capable of locating and aligning engine mounts on stringer brackets in inboard engine configurations where the engine is not directly mounted onto the stringers.

SUMMARY OF THE INVENTION

It is therefore an object of the present invention to provide an engine installation jig allowing for simple, rapid and precise engine mount and propeller shaft location and alignment.

It is another object of the present invention to provide an engine installation jig capable of locating and aligning engine mounts for engine mounting on stringer brackets or directly on stringers of a marine vessel.

It is a further object of the present invention to provide an engine installation jig adaptable for use with inboard engine mounts, stringers, stringer brackets and propeller shafts of a wide variety of original equipment manufacturers.

It is to be understood that other objects and advantages of the present invention will be made apparent by the following description of the drawings according to the present invention.

DETAILED DESCRIPTION OF THE PREFERRED EMBODIMENTS

The present invention relates, generally, to an engine installation jig 100, used to aid in the location and alignment of engine mounts and the propeller shaft in a marine vessel equipped with an inboard engine.

During use, the engine installation jig 100 is set into the engine bed of the vessel, adjusted to match the installation criteria of the engine and the propeller shaft being used, then secured to the stringers 10 either directly or via stringer brackets 20. Once the engine installation jig 100 is secured, the engine mount holes may be marked for subsequent drilling or drilled while the jig 100 is still in place. If stringer brackets 20 are being used, the jig 100 may also used to locate, secure and then drill the stringer brackets 20 for subsequent coupling of the stringer brackets 20 to the stringers 10.

Figure 1:
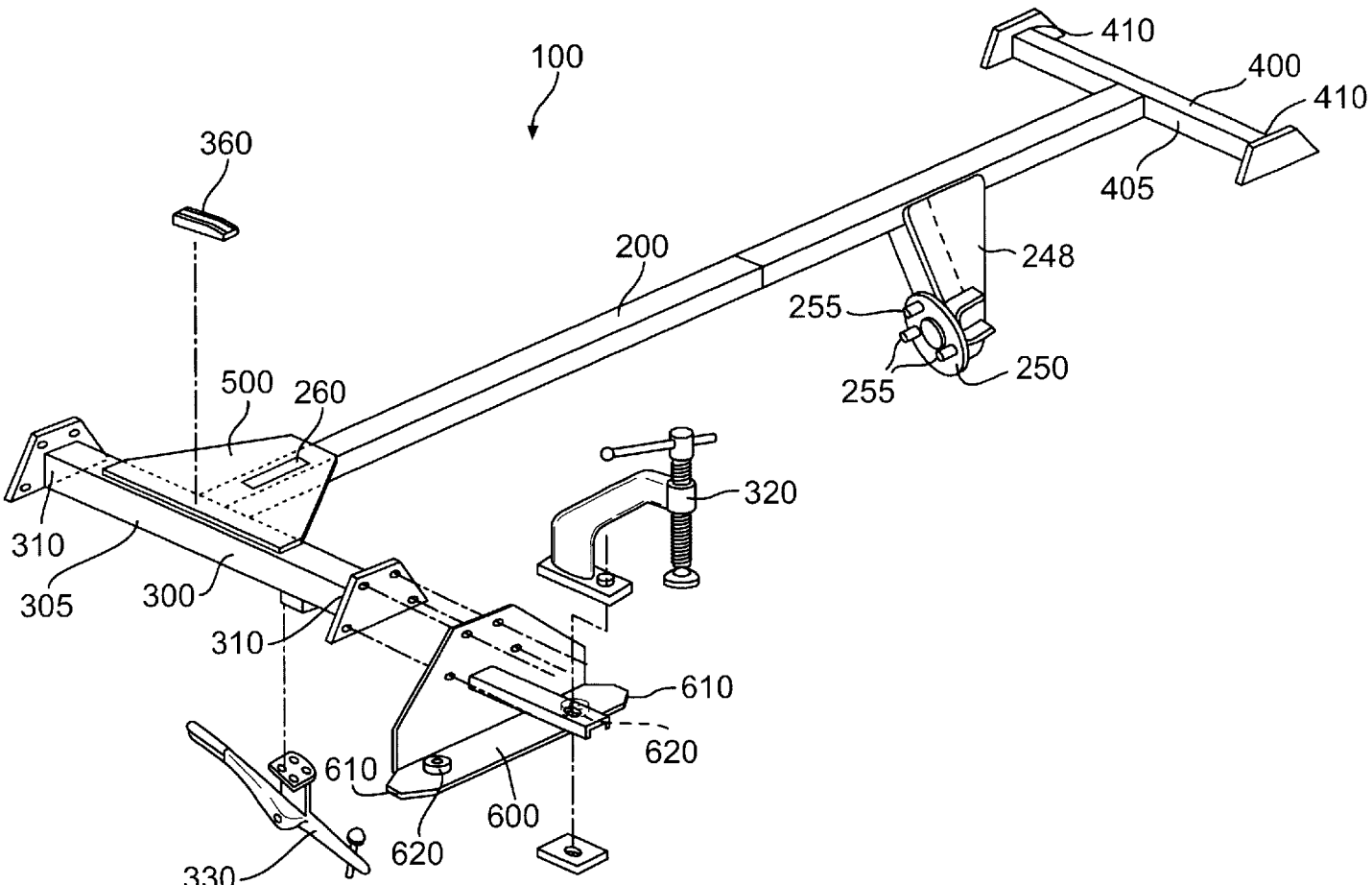
FIG. 1 is an exploded perspective view of the engine installation jig of the present invention.
Figure 2:
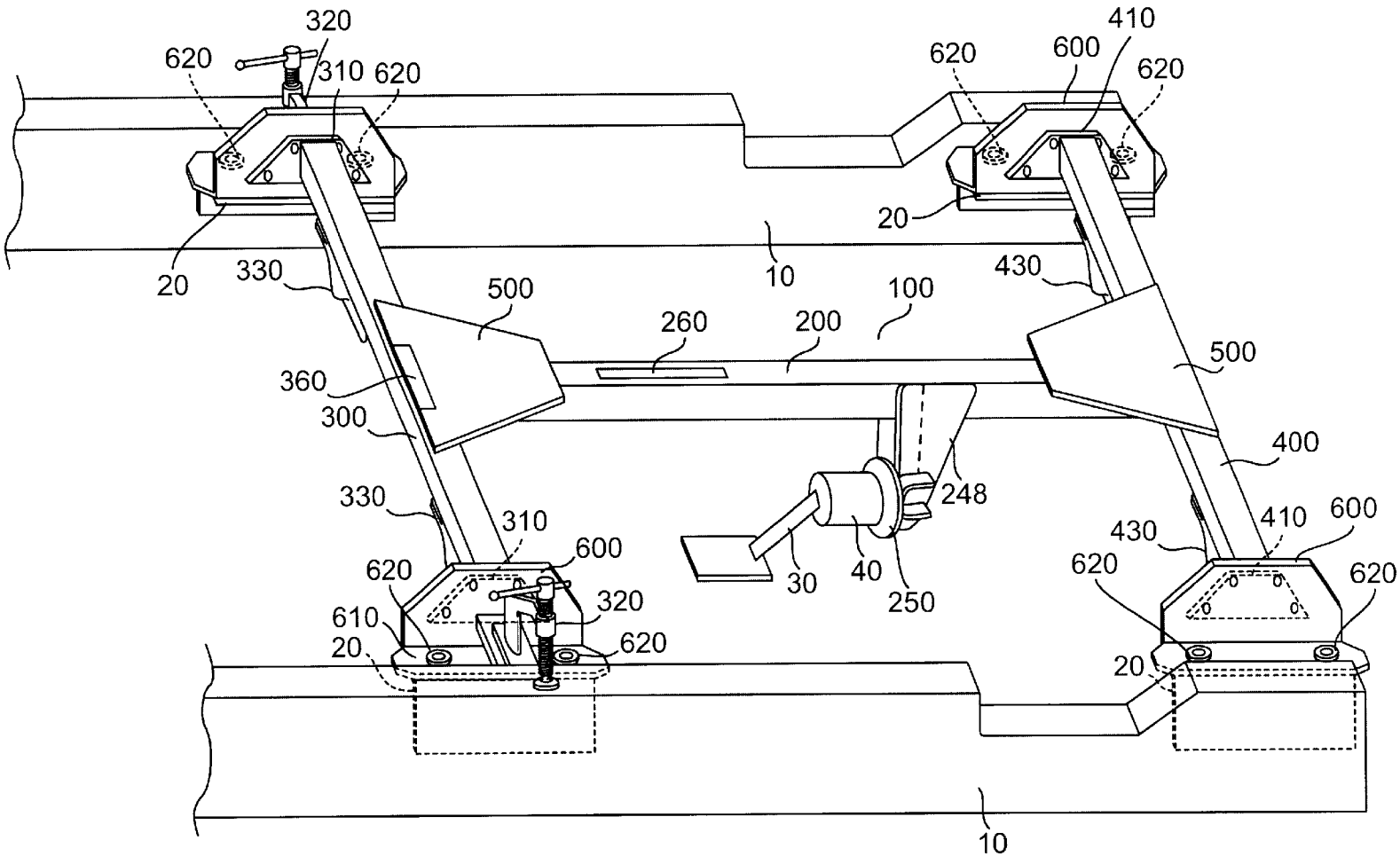
FIG. 2 is a perspective view of the engine installation jig of the present invention mounted in position within an engine bed of a marine vessel.
Figure 3:
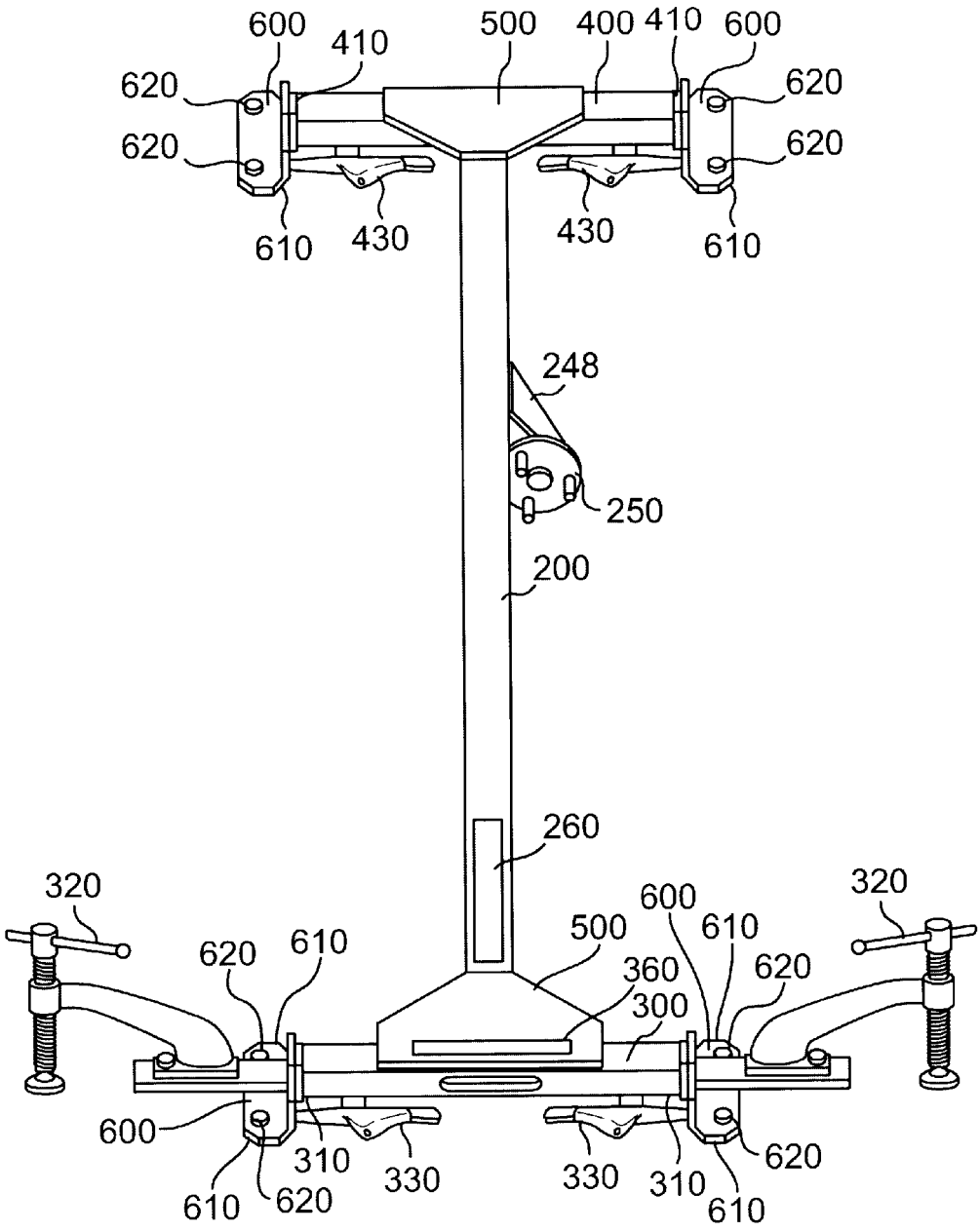
FIG. 3 is a top perspective view of the engine installation jig of FIG. 1.
Figure 4:
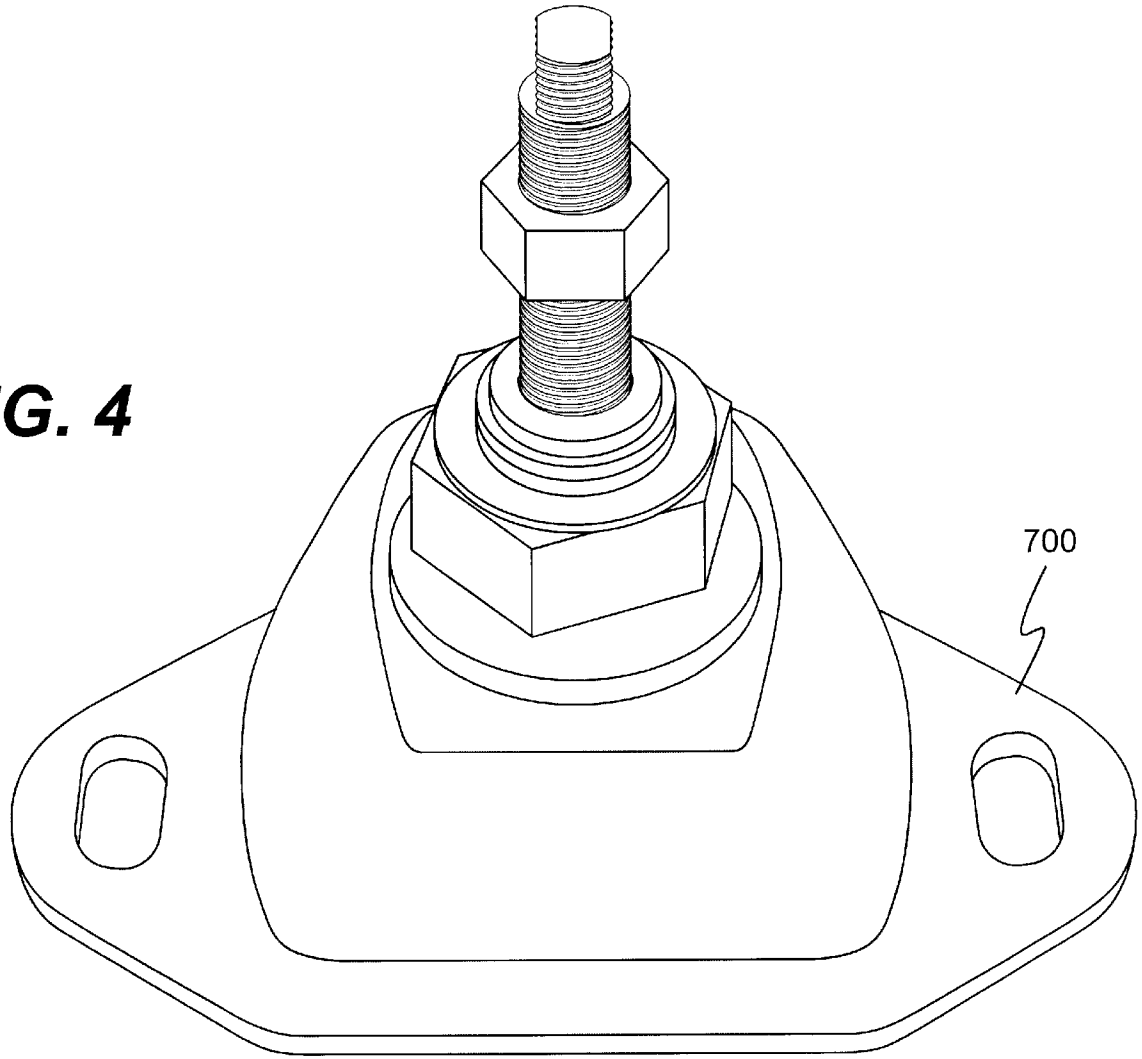
FIG. 4 is detailed perspective view of a convention rubber isolator for an inboard marine engine.

Referring now to FIGS. 1–3, jig 100 includes a longitudinal frame member 200, a first lateral crossbar frame member 300 and a second lateral crossbar frame member 400. Each of the first and second lateral members 300 and 400 are attached to the longitudinal frame member 200. Preferably, the first lateral member 300 is substantially perpendicular to and fixed to one end of the longitudinal member 200 and second lateral member 400 is substantially perpendicular and fixed to the other end of the longitudinal member 200. It is to be understood, however, that one or both of the lateral members 300 and 400 may be interchangeable and/or removably attached to the longitudinal member 200 at any point along the length of the longitudinal member 200 to accommodate inboard engines of different sizes and configurations. Additionally, the lateral members 300 and 400 may be designed to slide along the length of the longitudinal member 200. Furthermore, although shown in FIG. 1 as fixed-length rigid members, each of the longitudinal member 200, first lateral member 300, and second lateral member 400 may be telescoping frame members, adjustable in length to accommodate engines of varying sizes.

The jig of the preferred embodiment may include gusset plates 500 used to reinforce the connections between the lateral members 300 and 400 and the longitudinal member 200. The gusset plates 500 are shown in the preferred embodiment of FIG. 1 as trapezoidal, but may of any shape suitable to the specific jig configuration.

Referring back to FIG. 1, the jig 100 of the preferred embodiment also includes at least one end member, or drill fixture 600, removably attached to each end 310 and 410 of lateral members 300 and 400 respectively. The drill fixtures 600 are attached to ends 310 and 410 of the lateral members 300 and 400 via corrosion resistant bolts, dowel pins, thumb screws, cotter pins, or the like. The drill fixtures 600 also are provided with at least one substantially flat surface 610 to rest flush upon the stringer brackets 20 or the stringers 10 of the marine vessel.

In the preferred embodiment, the surface 610 of the drill fixtures 600 includes a plurality of drill bushings 620. The drill bushings 620 may be inserted and secured (by pressing or welding) into holes (not shown) formed in surface 610. The drill bushings 620 may also be removable and interchangeable; screwed or snapped into dew drill holes (not shown) formed in surface 610. The drill bushings 620 are located to match the holes n the rubber isolators 700 associated with the engine mounts and brackets of the inboard engine, an example of which is shown in FIG. 3. The drill bushing 620 are manufactured of a high strength material, such as hardened steel. The hardened material inhibits damage to the drill bushings 620 and the drill fixtures 600 while drilling through the drill bushings 620. Nonetheless, it is to be understood by one of ordinary skill in the art that the use of drill bushings 620 is optional. The drilling sites may be marked through the holes in the drill fixtures 600 and the drilling performed upon the removal of the jig 100 from the boat.

Each engine design may incorporate a differently contoured set of rubber isolators 70 and each rubber isolator 70 within a single engine design may be contoured differently. Likewise, stringer brackets 20 and sets of stringer brackets 20 may be variably contoured. Therefore, it is preferred that the contour of the surface 610 provide a visual representation of the rubber isolators 70 and the stringer brackets 20, if used, to aid in the placement and orientation of the drill fixtures upon the stringers 10 or stringer brackets 20. Moreover, each drill fixture 600 may be independently contoured to match the size and even the shape of each rubber isolator 70 and/or stringer bracket 20 being used. Furthermore, as mentioned above, each drill fixture 600 may be removably attached to the ends 310 and 410 of the lateral members 300 and 400, or interchangeable, to accommodate engine mounts of differing sizes and configurations.

The jig 100 of the preferred embodiment of FIG. 1 also includes leveling devices 320. It is preferred that the leveling devices 320 are each coupled to the drill fixtures 600, as shown in FIG. 1, and that the leveling devices 320 each contact the top surface of the stringers 10. In an embodiment of the present invention where the engine is mounted on stringer brackets 20, as shown in FIG. 2, the leveling devices 320 extend parallel to the first lateral member 300. In the embodiment of the present invention where the engine is mounted directly onto the stringers 10, the leveling devices 320 would be coupled to the drill fixture 600 so that the leveling devices 320 extend in a direction perpendicular to the first lateral member 300.

In one embodiment of the present invention, the leveling devices 320 may be utilized to hold the jig 100 in place while the engine mounts are marked and/or drilled. The leveling devices 320 may also be manipulated to adjust height of the jig 100 relative to the stringers 10 or the stringer brackets 20 as well as to level the jig 100 relative to the horizontal or the marine vessel. In the preferred embodiment of FIG. 1, the leveling devices 320 are of a vice-type or screw-type. However, it is to be understood by one of ordinary skill in the art that any means of fine-tuning the height and level of the jig 100, such as hydraulic jacks or bellows and shims may be used.

As discussed above, in the embodiment of the present invention, shown in FIG. 2, the engine is mounted on stringer brackets 20 and not directly on the stringers 10. In this embodiment, the fist lateral member 300 includes a set of securing devices 330 and the second lateral member 400 includes a set of securing devices 430. The securing devices 330 and 430 are preferably mounted on the bottom surfaces 305 and 405 proximate to the ends 310 and 410 of the first and second lateral members 300 and 400 respectively.

Once the jig 100 has been aligned with the stringers 10 using the leveling devices 320 and aligned with the stringer brackets 20 using the drill fixtures 600, the securing devices 330 and 430 are actuated to clamp the stringer brackets 20 to the jig 100. The stringer brackets 20 are then marked and/or drilled for subsequent attachment to the stringers 10. The securing devices 330 and 430 are preferably toggle-type clamps. Yet, it is to be understood by one of ordinary skill in the art that other means, such as vice-grip pliers or suction force, may be used to secure the jig 100 to the stringer brackets 20 for marking and/or drilling.

In addition to aiding in the alignment of the engine with the stringers 10 of the marine vessel, the jig 100 of the present invention aids in the alignment of the engine with the propeller shaft 30 of the marine vessel as well. In a conventional inboard engine and propeller shaft connection, a propeller shaft mating flange 40 is used to mate the propeller shaft 30 with a corresponding mating member on the transmission or gear box of the inboard engine (not shown). The propeller shaft mating flange 40 typically includes several apertures for receiving connecting members, such as bolts, to secure the propeller shaft mating flange 40 to the transmission or the gearbox of the inboard engine.

In the preferred embodiment of the present invention, the engine is aligned with the propeller shaft 30 via a fixture head 248. The fixture head 248 includes a pilot flange 250 used to simulate the propeller mating member on the transmission or gear box of the inboard engine (not shown). The pilot flange 250 mates to the propeller shaft mating flange 40 via mating members 255 that extend out from the surface of the pilot flange 250. The mating members 255 may be dowel pins or any members that suitably replicate the fastening members used to couple the propeller shaft mating flange 40 to the propeller mating member on the transmission or gearbox. Once the pilot flange 250 is mated with the propeller shaft mating flange 40, a clamping device (not shown), such as a toggle clamp or vice-grip pliers, may be used to secure the connection while the jig 100 alignment is completed.

The fixture head 248 is coupled to the longitudinal member 200 of the jig 100, as shown in FIG. 1. However, different propeller shafts enter the boat hull at different angles and may also be of differing lengths. Consequently, the fixture head 248 may be interchangeable, whereby the fixture head 248 would be removably fastened to the longitudinal member 200 via bolts, dowel pins, thumb screws, cotter pins, or the like.

Additionally, the fixture head 248 may be slidably or pivotally coupled to the longitudinal member 200 of the jig 100. Thus, the fixture head 248 may be then positioned and secured at any desirable point along the length of the longitudinal member 200 and at any desirable angle with respect to the longitudinal member 200. The fixture head 248 may also include plural sets of mating members 255 with the fixture head 248 mounted to rotate so that the desirable mating members 255 may be rotated into position to mate with the propeller shaft mating flange 40.The jig 100 of the preferred embodiment may also incorporate a lateral level sensor 360 and a longitudinal level sensor 260. The horizontal level sensor 360 is preferably mounted on one of the lateral members 300 or 400 and enables the installer of the jig 100 to level the jig 100 and the stringer brackets 20, if necessary, relative to the vessel or the true horizontal along the direction of the lateral members 300 and 400. The longitudinal level sensor 260 is preferably mounted on the longitudinal member 200 and enables the installer of the jig 100 to set the angle of the jig 100 and the stringer brackets 20, if necessary, to match to the angle of the propeller shaft coming through the bottom of the boat hull. The lateral and longitudinal level sensors 360 and 260 may be any of a number of commercially available level units of suitable size including digital-type level sensors.

The process of aligning the inboard engine for installation in the marine vessel according to the preferred embodiment of the present invention will now be described. Before installing the engine in the preferred embodiment of the present invention, the jig 100 is used to align both the engine mounts upon either the stringer brackets 20, or the stringers 10, and the propeller shaft 30. During engine alignment, the jig 100 is first mated to the propeller shaft 30. If the jig 100 does not have a fixed fixture head 248 attached thereto, the appropriate fixture head 248 is selected and attached to the jig 100. If the fixture head 248 is adjustable, the fixture head 248 is set to the desired position and secured in place. The mating members 255 on the pilot flange 250 are then inserted into the corresponding apertures on the propeller shaft mating flange 40. The pilot flange 250 is finally secured to the propeller shaft mating flange 40 via a clamping device (not shown).

Coupling the jig 100 first to the propeller shaft 30 and then to the stringer brackets 20 or stringers 10 according to the preferred embodiment has been described above. However, it is to be understood by one of ordinary skill in the art that the order of these steps may be reversed, as desired or needed, and first attach the jig 100 to the stringer brackets 20, or stringers 10, and then to the propeller shaft 30.

At this point the connection of the jig 100 to the propeller shaft 30 suspends the jig 100 above the hull of the boat. The jig 100 and the fixture head 248 may then manipulated so that the leveling devices 320 rest upon the stringers 10. The jig 100 is then positioned according to the installation criteria. If the engine is to be mounted directly onto the stringers 10, meaning no stringer brackets 20 will be used, the installation of the jig 100 is complete.

If stringer brackets 20 are being used, the stringer brackets 20 are positioned and coupled to the jig 100 via securing devices 330 and 430 for subsequent attachment to the stringers 10. This process begins with the alignment of the stringer brackets 20. The stringer brackets 20 are aligned along the fore and aft direction of the stringers 10 by maneuvering the stringer brackets manually in the same longitudinal direction. As mentioned, the contour of the surfaces 610 of the drill fixtures 600 provide a reference template of the stringer brackets 20 to aid in the alignment of the stringer brackets 20. The stringer brackets 20 are then positioned so that they lay flush against the stringers 10. Once the desired positioned of the stringer brackets 20 is located, the stringer brackets 20 are coupled to the jig 100 via securing devices 330 and 430. The installation of the jig 100 is now complete.

Now that the installation of the jig 100 is complete, the orientation of the jig 100 is adjusted according the installation criteria for the inboard engine being used. Level sensors 260 and 360 may be used to verify the orientation of the jig 100. Leveling devices 320 may be used in concert to adjust the vertical position of the jig 100 relative to the stringers 10 or independently to adjust the angular position of the jig 100 relative to the boat. If further fine-tuning adjustments are desired, the angle and longitudinal position of the jig 100 may then be adjusted accordingly.

The jig 100 has now been installed and precisely aligned. The drill holes for attaching the stringer brackets 20 to the stringers 10 (if stringer brackets 20 are used) and the drill holes for attaching the engine mounts to the stringer brackets 20 or stringers 10 may now be drilled. The drill holes may be drilled with the jig 100 still in place or marked for subsequent drilling upon removal of the jig 100. Once the holes are drilled or marked, the jig 100 may be removed from the boat.

The jig 100 of the preferred embodiment is designed to reduce the time and effort needed to install a engine in a boat. Therefore it is preferred that the jig 100 is manufactured from lightweight material, such as aluminum. The preferred structural square tubing of the longitudinal member 200 and the lateral members 300 and 400 along with the lightweight material make the jig 100 stronger and more manageable during the engine alignment and installation process. One of ordinary skill in the art would appreciate that other materials such as alloys, PVC tubing, composites and even wood of assorted cross-sectional shapes may used to manufacture the jig 100 and its components. In addition, since the jig 100 may come into frequent contact with seawater, the jig 100 is preferably either coated or fabricated out of a non-corrosive material.

As described above, the jig 100 of the present invention is adaptable to match the specifications of inboard engine mounts (including the rubber isolators), stringers, stringer brackets and propeller shafts of any original equipment manufacturers. Therefore, the time required to install the inboard engine is significantly reduced while maintaining the precision required for optimum engine performance.

We claim:

1. An engine installation jig comprising:

a longitudinal member;

a first lateral crossbar member coupled to said longitudinal member;

a second lateral crossbar member coupled to said longitudinal member;

a plurality of drill fixtures;

at least one leveling device; and a fixture head couplable to a propeller shaft;

wherein when said jig is installed into a marine vessel, said at least one leveling device is manipulated to adjust the position of said jig.

2. The engine installation jig of claim 1, further comprising at least one leveling sensor, said leveling sensor providing a visual indication of a planar orientation of said jig.

3. The engine installation jig of claim 1 wherein said at least one of said first lateral crossbar member and second lateral crossbar member are removable coupled to said longitudinal member.

4. The engine installation jig of claim 1 wherein said at least one of said first lateral crossbar member and second lateral crossbar member are slidably attached and selectively secured to said longitudinal member.

5. The engine installation jig of claim 1 wherein said longitudinal member is a telescoping longitudinal member.

6. The engine installation jig of claim 1 wherein said plurality of drill fixtures are coupled to ends of said first lateral crossbar member and said second lateral crossbar member according to predetermined engine installation criteria.

7. The engine installation jig of claim 1 wherein said plurality of drill fixtures are interchangeable.

8. The engine installation jig of claim 7 wherein said plurality of drill fixtures are contoured to give a visual representation of a plurality of engine mounts of the engine to be installed in the marine vessel.

9. The engine installation jig of claim 1 wherein said fixture head is removably coupled to said jig at a plurality of positions according to predetermined engine installation criteria.

10. The engine installation jig of claim 1 wherein said fixture head is pivotally coupled to said jig such that the angular orientation of said fixture head may be adjusted according to predetermined engine installation criteria.

11. The engine installation jig of claim 1, wherein said at least one leveling device couples said jig to stringers of the marine vessel.

* * * * *